United States Patent [19]

Völker et al.

[11] 4,342,794

[45] Aug. 3, 1982

[54] METHOD OF AND APPARATUS FOR PRODUCING ELECTRICAL CONDUCTOR WIRE

[75] Inventors: Wolfgang Völker; Fritz Pohlmann; Friedrich Radeck, all of Arolsen, Fed. Rep. of Germany

[73] Assignee: Felten & Guilleaume Carlswerk AG, Cologne, Fed. Rep. of Germany

[21] Appl. No.: 126,858

[22] Filed: Mar. 3, 1980

[30] Foreign Application Priority Data

Oct. 7, 1978 [DE] Fed. Rep. of Germany ..... 2843895

[51] Int. Cl.[3] ..... B05D 3/06

[52] U.S. Cl. ..... 427/54.1; 118/405; 118/643; 118/DIG. 18; 427/118; 427/120

[58] Field of Search ..... 427/54.1, 117, 118, 427/120; 118/DIG. 18, 405, 420, 642, 643; 34/1

[56] References Cited

U.S. PATENT DOCUMENTS

| | | | |
|---|---|---|---|
| 2,266,392 | 12/1941 | Durant et al. | 118/643 |
| 2,812,741 | 11/1957 | O'Connor | 118/420 |
| 2,994,624 | 8/1961 | Lit et al. | 427/120 |
| 3,669,720 | 6/1972 | Remer | 427/54.1 |
| 3,894,343 | 7/1975 | Pray et al. | 34/1 |
| 3,935,647 | 2/1976 | Aschberger | 34/1 |
| 4,117,196 | 9/1978 | Mathias | 427/120 |

*Primary Examiner*—John H. Newsome
*Attorney, Agent, or Firm*—Michael J. Striker

[57] ABSTRACT

A method of and an apparatus for producing an electrical conductor wire, especially a profiled heavy wire wherein the wire to be coated is guided subsequently through applying means, calibrating means and through a hardening chamber in which the individual layers of varnish are exposed to ultraviolet radiation of different intensity of irradiation. The layers which are applied onto the conductor wire in superposing manner have different properties wherein the wire is running through the apparatus after each occurring application of varnish.

21 Claims, 5 Drawing Figures

FIG.1
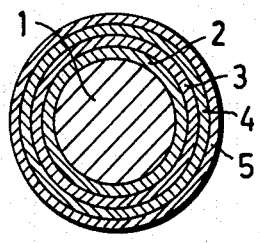
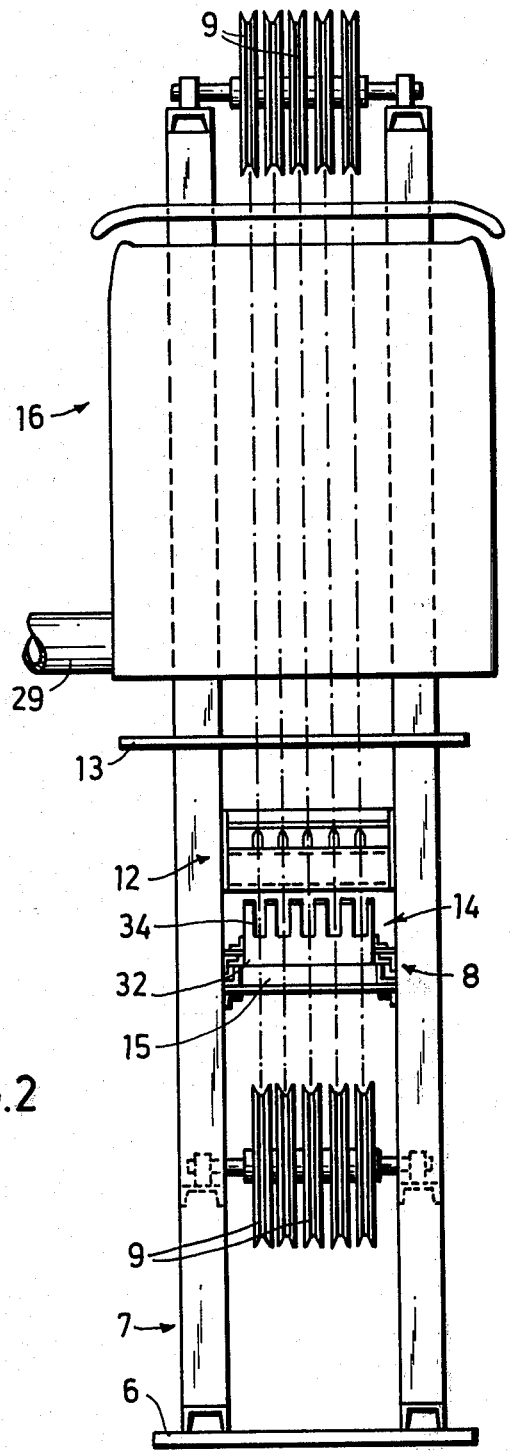
FIG.2

METHOD OF AND APPARATUS FOR PRODUCING ELECTRICAL CONDUCTOR WIRE

BACKGROUND OF THE INVENTION

The invention relates to a method of and to an apparatus for producing electrical wires. More particularly, this invention concerns an arrangement which produces electrical conductor wires, especially profiled heavy wires, by insulating the wires with varnish hardenable through ultraviolet radiation.

It is generally known to apply continuously insulated varnish onto a red hot and possibly pretreated wire and to calibrate the thickness of the varnished layer by stripping off superfluous varnish before hardening the varnished layer through outer influence of heat. The solvent contained in the insulating varnish is vaporized upon simultaneous cross linkage of the varnished film on the conductor since a thermochemical reaction is obtained which is caused by the heat energy. The varnished film so hardened forms a well adhering as well as heat resistant and mechanical proof insulation on the surface of the conductor. Through selection of the insulating varnish, it is possible to adapt the properties of the insulation to special purposes of use as it is described in the West German published application AS No. 10 33 291.

This known finishing technique seems to be rather sound concerning the quality of varnish wires so formed; however, it has the disadvantage, that the unhealthy vapor of solvent is released during the hardening and is subjecting therefore a relevant environment to contamination. Since the solvent which amounts up to 70% of the quantity of the applied insulating varnish cannot be recovered, high manufacturing and production costs are caused which are even increased by the high expenditure of energy and the high yield of waste which is unavoidable upon each starting of a manufacturing device and means for drying and hardening.

A still further problem of this known method are the high manufacturing expenses due to the means for drying and hardening, the use of which is very difficult when manufacturing varnished wires of different cross section and is impossible for greater diameters as for example for profiled heavy wires. Therefore, these profiled heavy wires are insulated by winding.

From the West German published application AS No. 24 59 320, there is known a method of and an apparatus for producing a protective layer of synthetic onto light wiring fibers, especially glass fibers. The fibers are coated by a liquid polyester resin hardening by ultraviolet radiation wherein the thickness of the layer is kept constantly by a stripper. The fiber so coated is then guided through a tubular ultraviolet radiator whose intensity of radiation is synchronized to the desired manufacturing rate so that the coating is bubble-free, smooth and cured after leaving the radiator. The thickness of the coating can be controlled under consideration of the viscosity of the liquid resin and the elasticity of the cured protective layer is adjusted by mixing different resins hardened through ultraviolet radiation.

The apparatus disclosed in this reference has a storage container for the polyester resin which is connected to a coating container via a level regulating device. In the bottom of the coating container, there is an entrance opening for the light wiring fiber which opening is sealed by a capillary tube. A stripper, one or several shields against ultraviolet radiation and a tubular ultraviolet radiator are arranged directly above the surface of the coating container.

The liquid coating used in this method contains photoinitiator systems in opposition to the common insulating varnish for conductor wires, thereby hardened and cross linked solely through the radiation with ultraviolet light which radiation is relatively poor in energy. There is no need to separate solvents by vaporizing which could contaminate the environment and causes the high expenditure on heat energy in common hardening of insulating varnish. Therefore, efforts were made to use such coating for the production of insulated electrical conductor wires.

It has been recognized, however, that the known method was not satisfactory when using in that field since it has been found that the different properties necessary for the insulation of the varnished wire were not sufficient when determining the properties of the cured coating by mixing different liquid coating materials hardenable through ultraviolet radiation. The insulation of electrical conductor wires must have different properties, like a good adhesion on the metallic conductor surface, a flexibility, high electrical insulating quality, heat resistance and mechanical strength, especially resistance against abrasive and a mar-resistance which properties cannot be achieved simultaneously by a known coating material or by a mixture thereof.

SUMMARY OF THE INVENTION

Accordingly, it is an object of the present invention to provide an apparatus which overcomes the difficulties of the prior art.

A more particular object of the invention is to provide an apparatus which achieves insulated conductor wires by applying a varnished insulation hardenable through ultraviolet radiation.

Another object of the invention is the provision of an improved method of and apparatus for producing electrical conductor wires which allow the production of high quality conductor wires.

A further object of the invention is to provide an apparatus which is of very simple and inexpensive construction.

Still a further object of the invention is to provide a method which does not cause any contamination of the environment.

Persuant to the above objects, and to others which will become apparent hereafter, a feature of the invention resides in applying subsequently at least one additional varnished layer onto a varnished layer which is already applied and cured, and to harden the additional varnished layer by means of ultraviolet radiation. In order to achieve different properties of the insulated wires, several varnished layers are applied continuously onto the wire and hardened by ultraviolet radiation. Therefore, in a preferred embodiment, there is applied onto the wire to be insulated, a layer of a well-adhering varnish of high flexibility, at least one layer of a dielectrical insulating varnish which is of high quality, at least one varnished layer which is heat resistant in the terminal state and finally a layer of an insulating varnish which has mechanical strength, especially is resistant against abrasive and mar-resistant and is sufficiently flexible when being in the terminal state.

During the production of profiled, for example band-shaped heavy wires which could have a cross section of more than 100 $mm^2$, varnish is applied which has a small surface tension in comparison with the surface e.g. metal surface to be coated in order to guarantee a coating of essentially uniform thickness with varnished layer also in the region of the edges of the profiled heavy wire which for example has a rectangular cross section of 4×20 mm.

The production of the insulating varnish according to the invention guarantees a high quality of the varnished wires and allows an extremely accurate adjustment of the properties of the varnished wires corresponding to the desired purpose of use. Since the selection of the varnish can be adapted to the desired properties, a most economical consumption of varnish is obtained to produce varnished wires having different quality requirements. The demand of energy is reduced to a tenth of the energy usually required in known methods, and due to the very low manufacturing costs of an apparatus according to the invention, superior properties are achieved by the present invention. In addition thereto, the method can be carried out by preventing any contamination of the environment and is also applicable to conductors insulated by varnish having a cross section of more than 100 $mm^2$ or having profiled for example rectangular cross section.

According to a further feature of the present invention, an apparatus for carrying out the method, briefly stated, comprises means for applying varnish onto the wire, the means having separated tanks each being arranged with a through opening for the wire to be coated, means for calibrating and stripping off superfluous varnish each of which is associated to one tank, and a hardening chamber in which at least one pair of ultraviolet radiators is arranged obliquely to the guide motion of the wire to be coated.

According to yet another feature of this invention, the hardening chamber is provided with a first group of reflectors each arranged behind the associated ultraviolet radiator for intensifying and for reflecting the irradiation to achieve an essentially uniform irradiation on the wires, and with a second group of reflectors located between two wires at a same distance from each other and arranged vertically to the ultraviolet radiators. In order to guide each wire through the apparatus, there are arranged two groups of several guide pulleys each group is provided at the respective end in longitudinal direction of the apparatus.

With an apparatus so developed, an optimum utilization is achieved since the same wire passes the apparatus several times wherein only a small duration or induction period of the ultraviolet radiation of a few seconds or only fractions of seconds is obtained depending on the composition of the used insulating varnish, to the thickness of the varnished layer and to the intensity of the irradiation. For example, a varnished film of about 25$\mu$ can be cured in 3 seconds, i.e. in 3 passages each lasting a second, by a radiator power of only 20 W/cm. The duration can, however, also amount to a multiple or only to a fraction of the magnitude depending on the required properties of the hardened varnished film and the respective composition of each used varnish wherein a preferred delivery velocity is for example 20 m/min. Apart from the delivery velocity the number of the passages is dependent on the length of the distance which is to be passed and subjected to the ultra-violet radiation, from the hardening time of each used varnish and from the required thickness of the applied varnish which thickness is preferably between 5 and 25$\mu$ wherein some layers are produced by multiple application of the same varnish, each application is followed by a hardening with ultraviolet radiation.

According to yet another feature of this invention, the ultraviolet radiators are constructed in bar-shaped manner and being arranged in pairs opposing each other in a housing wherein the radiative emission is uniformly distributed into the wires coated with varnish by the two groups of reflectors. The bar-shaped ultraviolet radiators, for example metallic vapor lamps, high pressure lamps or low pressure lamps, like mercury vapor lamps, ultraviolet radiator lamps, are available in different lengths in the commerce. Due to the arrangement in pairs of these lamps, for example HTQ or HOK or TL/05—radiators of the firm Phillips GmbH, an optimum use of the space and of the energy is achieved by guiding parallel a number of coated wires or pull of wires through the hardening chamber and simultaneously exposing them to the irradiation energy. The hardening chamber is developed in such a manner that the coated wires to be hardened are guided at a small distance approximately in the center between the pairs of lamps or between the reflectors arranged in rectangular plane thereto. Best results are achieved when arranging the wires at a distance of only 5 mm to the reflector or 20 mm to the surface of the radiators thereby obtaining no danger of contacting the lamps and/or the reflectors.

A further feature of the invention resides in keeping constant the temperature of the radiator by providing a cooling gas flow, for example air flow, since the operation of the ultra-violet radiator is dependent on the temperature. The best radiative emission is obtained with a relatively high temperature which, however, should not be exceeded in order to guarantee a correct operation within the hardening chamber.

According to yet another feature of this invention, there is arranged an infrared radiator superposed on the hardening chamber in order to obtain the optimum temperature range of over 100° C., preferably between 150° and 180° C. for the hardening reaction as quickly as possible. The arrangement in series of different pairs of ultraviolet radiators, also contributes to a control of the operational temperature within the hardening chamber. Thus, pairs of low pressure radiators are arranged in the lower region of the hardening chamber, the low pressure radiators emitting also a considerable portion of infrared radiation in addition to the ultraviolet radiation thus causing simultaneously a heating of the coatings to be hardened when the wire is entering the hardening chamber. The operating temperature, however, is reduced within given limits in direction to the upper region of the hardening chamber while the coated wires are irradiated intensively by ultraviolet generated by pairs of high pressure radiators arranged above the low pressure radiators within the hardening chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 shows a cross section of a varnished wire produced by the method according to the invention;

FIG. 2 is a front view of an apparatus according to the invention;

DESCRIPTION OF THE PREFERRED EMBODIMENTS

Figure 3:
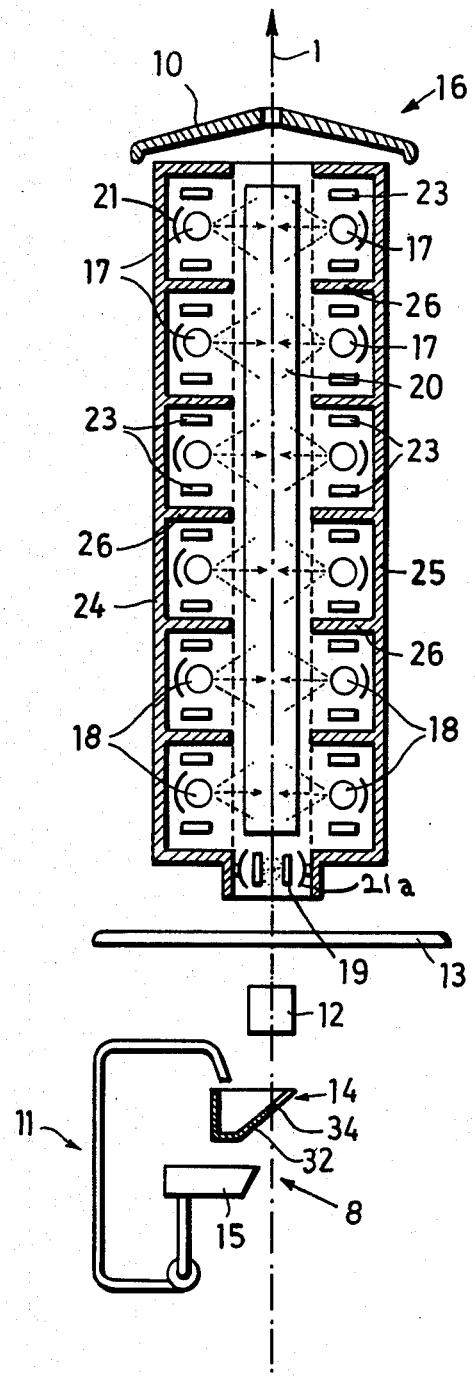
FIG. 3 is a vertical section of a hardening chamber of the apparatus according to FIG. 2 wherein means for applying varnish and means for calibrating the coating are additionally depicted, the hardening chamber being shown in incorrect scale.
Figure 4:
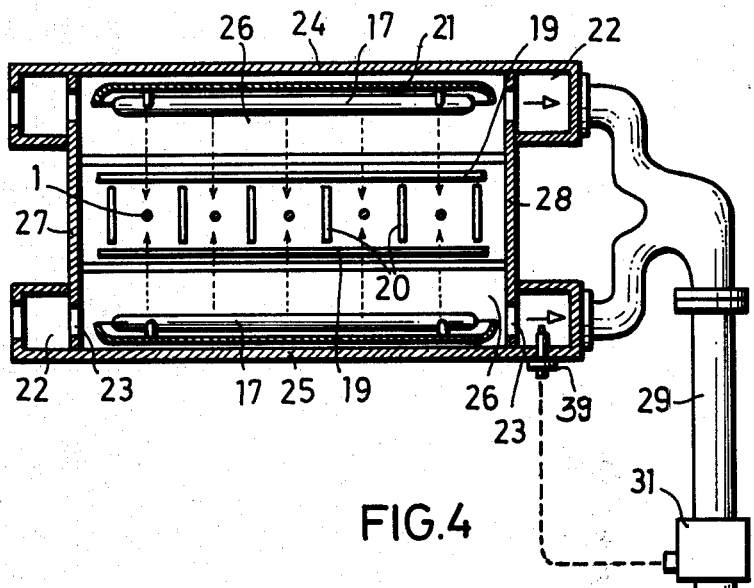
FIG. 4 is a horizontal section of the hardening chamber according to FIG. 2 wherein means for cooling the radiator are additionally depicted.

FIG. 1 shows a varnished wire having an electrical conductor 1, for example copper wire, which is insulated by a number of concentrically superposed varnished layers 2, 3, 4, 5 hardened after each coating by ultraviolet radiation. Each of the varnished layers is formed by multiple application of varnish of the same kind and subsequent hardening in order to achieve the required total thickness of the coating. The innermost layer 2 of insulating varnish which is applied onto the imute and possibly preheated bare conductor is well and permanently adhering in the liquid state as well as in the cured state all over the metallic surface of the conductor even along the edges. On the innermost layer 2, there is applied the additional varnished layer 3 having superior insulating properties and which is superimposed by the special heat resistant varnished layer 4 on which the concentric outermost top layer 5 is applied which in its hardened state has a mechanical strength especially is resistant against abrasive and mar resistant. It is also possible, to manufacture heavy wires, insulated by varnish, with conductors 1 of arbitrary cross section, like for example rectangular, square or other cross sectional shape as well as with a cross sectional plane up to more than 100 $mm^2$ in the same manner. The number and the thickness of the individual layers depends on the purpose of use of the varnished wire so produced. However, in conductors 1 having an edged cross-section shape it is recommended to use for the innermost layer 2 such an insulating varnish which has a small surface tension relative to the metallic conductor surface so that the edges are covered with the same thickness of layer as the remaining surface of the conductors.

In order to achieve superior results, it has been found to apply each varnished layer in a layer thickness of at least 5$\mu$, preferably 15 to 20$\mu$ and then exposing the layer to the irradiation for a relatively short time and finally to cure it temporarily by at least a further ultraviolet radiation. In this context it is to be noted, that the same wire can be exposed subsequently several times to the ultraviolet radiation by respective deflection of the wire. Since layers of more than 20$\mu$ can hardly be cured even when repeating the process, and for layers below 5$\mu$ the formation of an overall homogeneous film cannot be guaranteed, it is preferred to compose each of the varnished layer 2, 3, 4 or 5 of several individual layers.

After each application, the coated conductor wire 1 is exposed to the ultraviolet radiation for a period of less than 25 seconds, preferably between 3 and 15 seconds, at a temperature of more than 100° C., preferably between 150° and 180° C. This can be performed in one operation when the hardening chamber is respectively dimensioned, or in several operations which is preferred in consideration of a use of the hardening chamber in a more economical way. High reactive insulating varnishes suitable, however only for certain purposes can be cured by shorter exposure to ultraviolet radiation, for example already in 0.2 to 0.3 seconds. The deflection for returning the varnished wire provided with a partly hardened coating occurs preferably at a varnish temperature of less than 100° C. in order to avoid plastic deformations of the insulating layer. For some purpose, the varnish must be applied and/or cured under exclusion of air or under inert protective gas, for example nitrogen, in order to obtain the desired porperties in the hardened state or because varnish having certain superior properties can be hardened only in that way.

An apparatus according to the invention is illustrated in the FIGS. 2 to 5 and has a common platform 6 on which a supporting frame 7 is mounted in upright position. In the lower region of the supporting frame 7, at a distance to the platforms 6, there is arranged a first group of guide pulleys 9 which draw off the bare wires from a winding off device (not shown) which is preferably associated to the common platform 6. Above the first group of guide pulleys 9, applying means 8 for varnish are provided. Stripping off and calibrating means 12 are associated to and arranged above the applying means 8 which means 12 is superimposed by a shield 13 which is screening the mentioned means against the ultraviolet radiation. Thus, an abnormally and prematurely hardening of the varnish as well as losses of radiation are prevented. Between the shield 13 and a light trap 10 which is provided at a distance to the top of the supporting frame 7, a hardening chamber 16 is arranged in which the actual hardening of the individual varnish layers is obtained. Above the light trap 10, on the top of the supporting frame 7, a second group of guide pulleys 9 is provided in order to allow a reversing of the wire to the lower group of guide pulleys 9 outside of the apparatus. Thus, it is possible to guide the wire several times through the individual means 8 and 12 and through the hardening chamber 16. As already mentioned, the numbers of operations depend on the thickness of the individual varnished layers. When the varnished layer is coated with the finished varnished insulation and therefore ready for use, the wire is fed to a winding-on device (not shown).

Referring now to FIG. 3, the hardening chamber 16 and the stripping off and calibrating means 12 are shown in more details. The applying means 8 having several separated tanks 14 whose content is level controlled. The tanks 14 are arranged side-by-side in groups divided from each other by a partition or in laterally disposed individual tanks, each tank 14 being separatedly associated to one stripping-off and calibrating means 12. Thus, a concentric application of varnish and hardening of several mating layers as well as a repeated second cure of an individual applied layer of insulating varnish is rendered possible. In the latter case, the coated conductor 1 can be guided over correspondingly staggered guide pulleys 9 or through tanks 14 containing no varnish when the guide pulleys 9 are coaxially arranged.

In a preferred embodiment, the tanks 14 or the groups of tanks divided by a partition, are provided in a trough-shaped manner and having a side wall 32 which is inwardly inclined or curved and backwardly directed wherein vertical slits 34 are provided in the side wall 32 as through openings which slits are open to the outside. In order to collect the varnish flowing out through the slits 34, collecting containers 15 are provided below the tanks 14. The collecting containers 15 are connected to a device 11 for continuously returning the varnish therefrom into the tanks 14 and are arranged in a position corresponding to the rearwardly directed bottom edge of the tanks 14 at a small distance to the vertical guide motion of the wire which is passing the slits 34. Thus, a continuous cycle of insulating varnish from the collecting containers 15 into the tanks 14 is achieved since the part of varnish which is not adhering on the wire is flowing out through the slits 34 along the inclined or curved sidewall 32 into the collecting container 15. In this manner, the level in each tank 14 is kept constant wherein a compensation of spent insulating varnish can be executed in certain periods.

The development of the hardening chamber 16 is of great importance for achieving successful and economical results of the previously described method. Therefore, the hardening chamber 16 is constructed as a box-shaped housing having side walls 24 and 25 and end walls 27 and 28, as can be seen from FIGS. 3 and 4. The height of the hardening chamber 16 corresponds approximately to the length of the section which is exposed to the ultraviolet radiation. Pairs of bar-shaped ultraviolet radiators are arranged transversely to the movement of the wire 1 in superposing manner wherein the radiators of each pair are provided diametrically opposite at the side walls 24 or 25 of the hardening chamber 16. The distance between two individual pairs is chosen in such a manner that depending on the intensity of irradiation by the radiators, on overlapping of the emission areas is achieved. In the shown embodiment of the hardening chamber 16, two pairs of low pressure ultraviolet radiators 18 are superposed by four pairs of high pressure ultraviolet radiators 17 wherein the distance between two superimposing pairs is 200 mm and the distance between two radiators of each pair is not more than 50 mm, preferably 40 mm. Therefore, the coated wire guided centrally inbetween is exposed to an intensive irradiation without any danger of contact. In the hardening chamber 16, two groups of reflectors are provided in order to even more intensify and to reflect the irradiation thereby achieving that the coating to be hardened is irradiated from all sides in an essentially uniform manner. The one group of reflectors 21 is arranged, preferably concavely curved, behind each radiator 17, 18 while the other group of plane reflectors 20 is arranged in upright position between the pairs of radiators in a plane perpendicular to the axis of the pairs of radiators.

As already explained, the low pressure ultraviolet radiators 18 are provided in the lower region of the hardening chamber 16 and are emitting additionally a relevant infrared radiation. For a fast heating up of the coating to be hardened up to the reaction temperature, and auxiliary infrared radiator 19 is superposed on the hardening chamber 16 in axis parallel direction to the radiators 17, 18 on both sides of the conductor wire 1 at its entrance to the hardening chamber 16 wherein a concave reflector 21*a* is arranged behind each infrared radiator. Thus, the reaction temperature of the outermost coating is obtained as quickly as possible without any relevant heating of the conductor 1 or of the coating already cured, thereby essentially contributing to a reduced demand of energy. As above mentioned, an effective operation of the ultraviolet radiator 17, 18 occurs only when obtaining a constant and relatively high operating temperature of generally more than 400° C. which, however, is not to be exceeded over the critical value of 500° C. since otherwise operating troubles are to be expected due to a deficiency of the radiator. Therefore, the hardening chamber 16 is provided with an effective gas cooling system, preferably air-cooling, in the area of all radiators.

For obtaining such a gas cooling, gas ducts 22 are arranged on the end walls 27, 28 of the hardening chamber 16. In the region of the gas ducts, passages 23 are provided in the end walls 27 and 28 in elongated direction of the radiators 17, 18. A number of baffle plates 26 for the cooling gas are inwardly directed from both side walls 24 and 25 which baffle plates are located in axis parallel alignment inbetween two superposing ultraviolet radiators. The gas ducts 22 on the end wall 28 are connected to an exhaustor 30 via a pipe system 29. In view of a uniform manufacture of the housing of the hardening chamber, and of the fact that the connections to the pipe system 29 are dependent on the available space as well as of a simple modification of the hardening chamber 16 for an operation under exclusion of air, the gas ducts are preferably provided on both end walls 27, 28.

During a simple air cooling, the connections of the gas ducts 22 on the end wall 27 which are not associated to the exhauster 30, remain open or can be connected with pipes (not shown) and/or air filters (not shown) for introducing intake air from outside. Due to this arrangement, the flow of air is essentially cooling the radiators 17,18 since the air is passing along the baffle plates 26 which are located between two superposing radiators and axis parallel thereto. For keeping constant the radiator temperature, the quantity of the cooling gas so guided can be controlled by thermostats 39 arranged in the end region of the radiators or within the gas duct 22 and acting on at least a flow volume regulator 31, within the pipe 29, for example a swingable flap. This cooling system can be easily modified for an operation with protective gas by connecting the outlet of the exhauster 30 to a gas storage via corresponding pipes, preferably by interposing a recooling device wherein the gas storage is connected to of the gas duct 22 at the end wall 27 of the hardening chamber 16.

Figure 5:
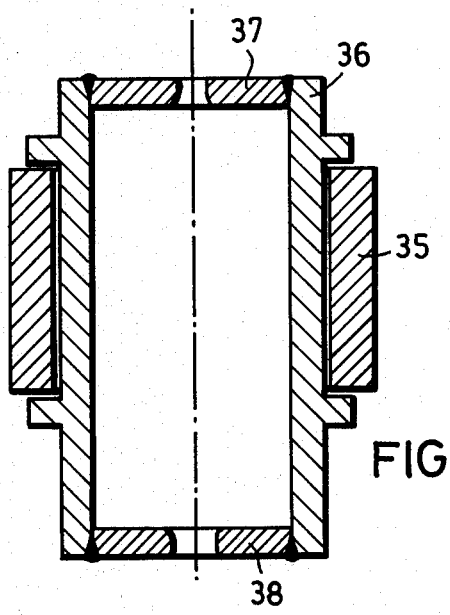
FIG. 5 is a section of an embodiment of the means for stripping off and calibrating according to FIG. 2.

Referring now to FIG. 5, there is illustrated the stripping off and calibrating means 12 which is essential for adjusting the thickness of each applied insulating varnish. Each of the stripping off and calibrating means 12 is developed in correspondance with the outline of the wire 1 to be coated, and has portions 36 which are movable from and towards each other in a guide 35 and can be kept together by elastic force. At each end of each movable portion 36 and perpendicular to the guide motion of the wire, there are arranged strippers 37, 38. In the present embodiment, the means 12 is provided for circular conductors 1 and is developed in autocentering manner by means of the strippers 37, 38 which are stripping off superfluous varnish adhering on the coated wire thereby adjusting the intended thickness of the layer. In this context, it is to be noted that there are provided for each thickness of the layer, different strippers having an accurate dimension of its opening.

For calibrating the applied varnish onto the surface of profiled heavy wires, the stripping off and calibrating means 12 have in cross section H-shaped or double T-shaped guiding portions, in which recesses segmentally shaped or square shaped strippers 37, 38 are guided having serrated stripper surfaces the groovings of which have a depth corresponding to the desired thickness of the applied varnish. The strippers are kept against each other by means of a spring force so that calibrating surfaces are sliding on the surface to be applied and stripping off the superfluous varnish. It is to be noted however, that the strippers are stripping off varnish only to such an extent, that due to the cohesive force and adhesive force, the varnish is distributing on the surface of the wire in order to obtain a uniform film of intended thickness.

With the described apparatus, high quality conductor wires of arbitrary cross section can be insulated by varnish in an extremely economical manner without any contamination of the environment.

It will be understood that each of the elements described above, or two or more together, may also find a useful application in other types of apparatus for producing an electrical conductor wires differing from the types described above.

While the invention has been illustrated and described as embodied in an apparatus for producing electrical conductor wires, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing electrical conductor wires, especially profiled heavy wires, having the steps of providing a vertical supporting frame supported on a platform and including at least two sets of guide pulleys arranged in longitudinal direction so that one set of guide pulleys is provided at a distance to the platform on one end of the supporting frame, and the other set of guide pulleys is provided on the top of the supporting frame; applying varnish onto the conductor wire in applying means above the one set of guide pulleys in separated tanks each provided with throughopenings for the wire to be coated; calibrating the thickness of the varnished layer by stripping off superfluous varnish in calibrating means directly above the applying means and each being associated with one individual tank; hardening the applied and calibrated varnish in a hardening chamber arranged between the other set of guide pulleys and the calibrating means, wherein the improvement comprises: applying the varnish onto the conductor wire in the tanks in groups or of laterally disposed individual tanks; hardening the applied and calibrated varnish by ultraviolet radiation by at least a first pair of ultraviolet radiators within the hardening chamber and disposed transversely to the guide motion of the wires, and at least a second pair of ultraviolet radiators located parallel above the first pair of ultraviolet radiators and having a higher intensity of radiation than the first pair of ultraviolet radiators; intensifying and reflecting the radiation by a first group of reflectors each provided behind each ultraviolet radiator and a second group of reflectors each arranged equi-distantly between two wires, the reflectors being perpendicular to the longitudinal axis of the respective ultraviolet radiator; and cooling by cooling means connected to the hardening chamber to achieve an optimum temperature.

2. A method as defined in claim 1, wherein the applying step includes applying a first layer of a well adhering varnish of high flexibility directly onto the surface of the wire, at least a second layer of a dielectrically high quality insulating varnish and surrounding the first layer, at least a third layer of an insulating varnish which is heat-resistant in the final state and superposing the second layer, and a fourth layer of an insulating varnish applied on the third layer and being mechanically resistant, especially resistant against abrasion and mar-resistant as well as suitably flexible in the final state, and the hardening step including hardening each layer by UV radiation after each respective application.

3. A method as defined in claim 2, wherein the hardening step includes preheating each varnished layer by subjecting to infra-red radiation and subsequently irradiating each varnished layer by sequential exposure to at least two sources of ultraviolet radiation having differing intensity of irradiation from each other.

4. A method as defined in claim 3, wherein each varnished layer is applied at a thickness of at least $5\mu$.

5. A method as defined in claim 4, wherein each varnished layer is applied at a thickness of 15 to $20\mu$.

6. A method as defined in claim 2, wherein the conductor wire to be coated is exposed to the ultraviolet radiation after each application of varnish for a period of less than 25 seconds.

7. A method as defined in claim 6, wherein the conductor wire to be coated is exposed to the ultraviolet radiation after each application of varnish for a period between 3 and 15 seconds.

8. A method as defined in claim 7, wherein the conductor wire to be coated is exposed to the ultraviolet radiation after each application of varnish at a temperature of more than 100° C.

9. A method as defined in claim 8, wherein the conductor wire to be coated is exposed to the ultraviolet radiation after each application of varnish at a temperature between 150° and 180° C.

10. A method as defined in claim 3, wherein each varnished layer is pretreated by short exposure to ultraviolet radiation and cured by at least a further ultraviolet radiation of higher intensity of irradiation.

11. A method as defined in claim 2, wherein the conductor wire having prehardened or partly hardened varnished layer is deflected twice after being cooled to below 100° C. for returning the wire for another passage in the same guide motion through the ultraviolet radiation, or after hardening of the respective layer to the following varnish to be applied.

12. A method as defined in claim 10, wherein at least one of the varnished layers is applied and/or hardened under exclusion of air or under protective gas.

13. An apparatus for producing electrical conductor wires, especially profiled heavy wires, having a vertical supporting frame supported on a platform, the supporting frame including at least two sets of guide pulleys arranged in longitudinal direction, one set of guide pulleys being provided at a distance to the platform on one end of the supporting frame, the other set of guide pulleys being provided on the top of the supporting frame; means for applying varnish onto the conductor wire, the applying means being located above the one set of guide pulleys and having separated tanks each provided with through openings for the wire to be coated, means for calibrating the thickness of the varnished layer by stripping off superfluous varnish, the calibrating means being arranged directly above the applying means and each being associated with one individual tank, a hardening chamber arranged between the other set of guide pulleys and the calibrating means, wherein the improvement comprises: an arrangement of the tanks in groups or of laterally disposed individual tanks, at least a first pair of ultraviolet radiators within the hardening chamber and disposed transversely to the guide motion of the wires, at least a second pair of ultraviolet radiators located parallel above the first pair of ultraviolet radiators and having a higher intensity of radiation than the first pair of ultraviolet radiators, a first group of reflectors each provided behind each ultraviolet radiator for intensifying and reflecting the radiation, a second group of reflectors each arranged equi-distantly between two wires, the reflectors being perpendicular to the longitudinal axis of the respective ultraviolet radiator, and cooling means connected to the hardening chamber to achieve an optimum temperature.

14. An apparatus as defined in claim 13, wherein the first pair of ultraviolet radiators are low pressure radiators arranged ahead of the second pair of ultraviolet radiators which are high pressure radiators wherein the low pressure radiators emit additionally infrared radiation for accelerating the heating of the varnish up to the reaction temperature.

15. An apparatus as defined in claim 13, wherein each reflector of the first group of reflectors has a concave shape, and each reflector of the second group of reflectors has a plane surface.

16. An apparatus as defined in claim 13, wherein the apparatus further comprises a shield located between the hardening chamber and the calibrating means, and a light trap between the other set of guide pulleys on the top of the supporting frame and the hardening chamber.

17. An apparatus as defined in claim 14, wherein an infrared radiator is arranged ahead of the pair of low pressure radiators.

18. An apparatus as defined in claim 13, wherein the cooling means including gas ducts at a distance from each other at each end wall of the hardening chamber, each of which end walls hving a passage in elongating direction of each ultraviolet radiator; and a group of baffle plates for cooling gas, each baffle plate is integrally developed with each side wall of the hardening chamber and is arranged inwardly and rectangularly thereof in axial parallel alignment with the ultraviolet radiators and located inbetween two superposing ultraviolet radiators.

19. An apparatus as defined in claim 18 wherein the gas ducts and passages on one of the two end walls are connected to the atmosphere, and the gas ducts and passages of the other of the two end walls are connected to at least one exhauster via a pipe system in which at least one flow volume regulator is provided for controlling the quantity of flow of cooling air depending on the temperature.

20. An apparatus as defined in claim 13, wherein the individual tanks of the applying means are trough-shaped and constructed with an inwardly inclined or curved side wall which is backwardly directed in which upper portion vertical slits open to the outside are provided as through openings wherein collecting containers are arranged below the backwardly directing bottom edge of the tanks for collecting the varnish flowing out of the slits, the collecting containers being connected with devices for continuously returning the varnish into the tank and arranged in a position which is rearwardly staggered at a small distance to the vertical guide motion of the wire passing the slits.

21. An apparatus as defined in claim 13, wherein each calibrating means has portions movable laterally from and towards each other in a guide which portions are kept together by elastic force and have a profile which corresponds to the wire to be coated.

* * * * *